United States Patent [19]

Ramoneda Sibidi

[11] 3,949,792

[45] Apr. 13, 1976

[54] CONSTRUCTION OF VALVES FOR BOTTLING MACHINES

[75] Inventor: Juan Ramoneda Sibidi, Sabadell (Barna), Spain

[73] Assignee: Mecano Quimica, S.A., Barcelona, Spain

[22] Filed: Feb. 20, 1975

[21] Appl. No.: 551,384

[30] Foreign Application Priority Data

Feb. 21, 1974 Spain ..... 423475

[52] U.S. Cl. ..... 141/198; 141/351

[51] Int. Cl.[2] ..... B65B 3/26

[58] Field of Search ..... 141/1–12, 39, 141/40, 47–50, 54–56, 59, 165, 166, 192, 198, 250, 275, 312, 351–362

[56] References Cited

UNITED STATES PATENTS 3,857,424 12/1974 Roberts ..... 141/351

*Primary Examiner*—Houston S. Bell, Jr.

*Attorney, Agent, or Firm*—Haseltine, Lake & Waters

[57] ABSTRACT

A valve assembly for a bottling machine composed of a mechanical unit and a pneumatic assembly mounted on a single support. The mechanical assembly includes a bottle centerer which places the neck of a bottle in a suitable position in relation to the centerer and which is displaced vertically by the bottle to act on an activating valve of the pneumatic assembly to activate a pneumatic cylinder. The piston of the cylinder moves downwards and draws with it a tubular air duct to which is attached a nozzle, which moves inside a coaxial tubular channel member defining an intermediate space for the passage of liquid. The liquid is discharged at the end of the channel member, when the nozzle is in extended position to fill the bottle whereupon the liquid blocks the nozzle and prevents the exit of compressed air from the duct at a low pressure and rate. The pneumatic assembly detects this condition and reverses the cylinder, so that the air duct is retracted and the nozzle blocks the outlet of liquid from the channel member.

9 Claims, 1 Drawing Figure

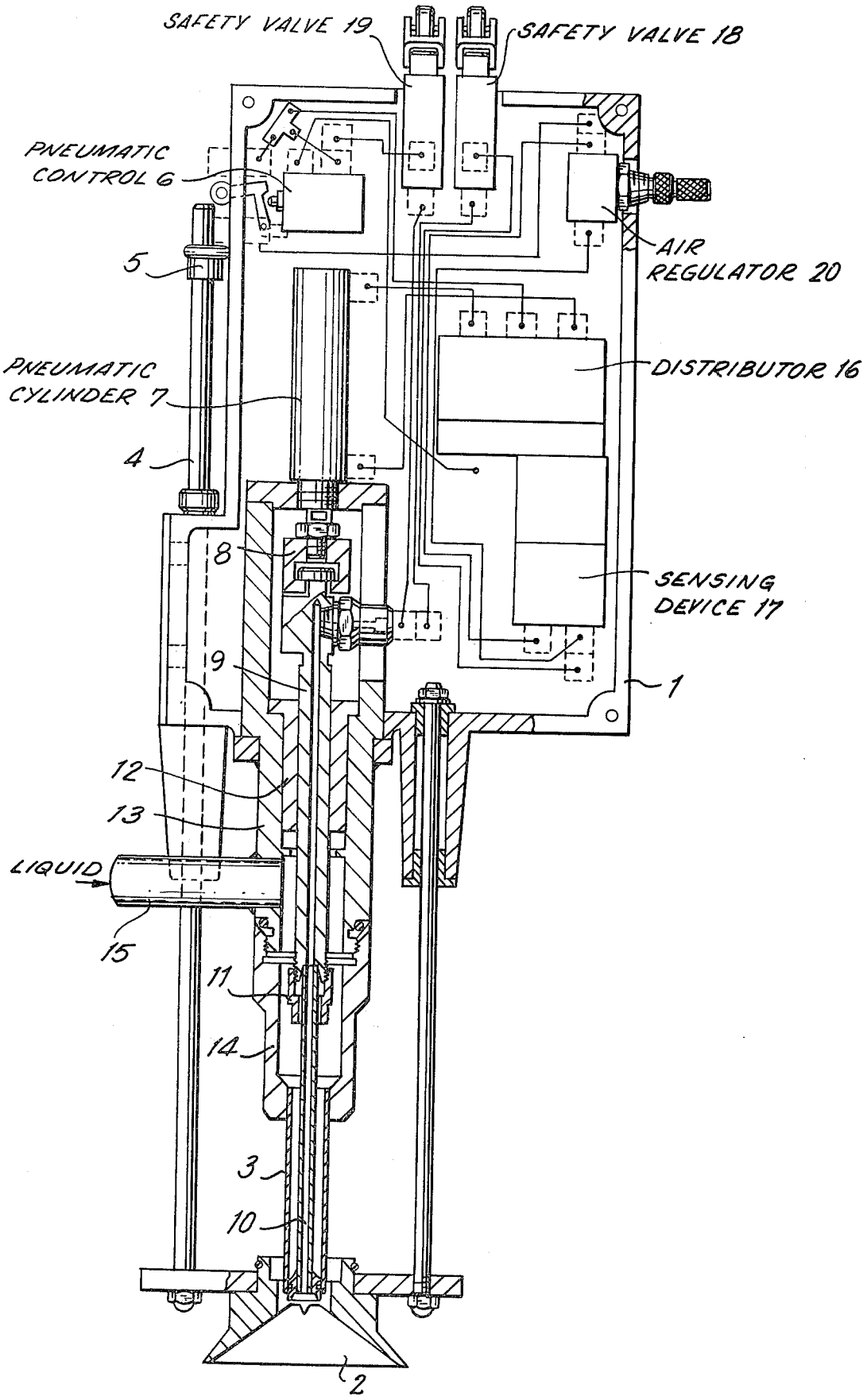
SAFETY VALVE 19
SAFETY VALVE 18
PNEUMATIC CONTROL 6
AIR REGULATOR 20
5
PNEUMATIC CYLINDER 7
DISTRIBUTOR 16
4
8
SENSING DEVICE 17
9
1
12
13
LIQUID
15
11
14
3
10
2

CONSTRUCTION OF VALVES FOR BOTTLING MACHINES

FIELD OF THE INVENTION

The invention relates to improvements in bottling machines used in beverage bottling plants, and particularly to improved valve means thereof adapted to provide important advantages.

BACKGROUND AND SUMMARY OF THE INVENTION

The valve of the present invention is employed to fill bottles regardless of their form or size, with no need to form a leak-proof seal with them, so much so that the lack of rigidity or the relative imperfection of the bottle is no obstacle to the correct and rapid filling of the bottle. The valve according to the invention, does not work by vacuum, but it acts with pressure on the liquid, for which reason the viscosity of the liquid does not constitute any problem in the bottling, contrary to what happens with the conventional vacuum or gravity filling valves, in which these factors are critical.

The valve embodying the improvements of the invention is related to valves of the type containing a pneumatic part and a mechanical part, the valve construction being such that the two parts are mounted in a single assembly, in a simplified form, with the additional advantage that both parts are perfectly aligned, thereby economizing in space and improving the performance, with the constructional characteristic that in the mechanical part the substitution of a liquid channel member (fine tube) and the air nozzle is easily carried out in cases where it is necessary to increase or decrease the size of these parts in accordance with the different diameters of the necks of the bottles to be filled.

The improvements include additionally, means for closing the liquid flow when not required. The outlet of liquid in the valve is made through no more than two openings, thereby avoiding the production of scum, contrary to what happens with certain conventional valves in which the liquid leaves through various small orifices in the form of several small jets.

In the valve in accordance with the invention, the pneumatic cylinder which opens and closes the nozzles is of dual-action type, thereby obtaining greater speed in the response to the stimulus as compared with conventional valves whose cylinders are of single action type.

In the valve according to the invention the desired liquid level inside the bottle is not obtained by suction or by sealing and it operates without establishing contact with the leakproof seal. Instead the liquid level is obtained by using a so-called pneumatic "probe" which detects the presence of the liquid when it reaches a chosen level.

BRIEF DESCRIPTION OF THE DRAWING

The sole FIGURE of the drawing is a longitudinal sectional view taken through the valve of the invention inclusive of a pneumatic circuit diagram.

DETAILED DESCRIPTION

Referring to the drawing, therein is seen a valve for a bottling machine, which comprises a support housing 1 supporting a mechanical unit, a pneumatic assembly and a centering machine for the bottles to be filled.

In the mechanical unit, a bottle centerer, shown at 2, places the neck of the bottles in a suitable position in relation to the centerer so that an exterior filling channel 3 can penetrate into the necks of the bottles. At the same time, a vertical movement of this centerer, achieved either by lowering the valve or raising the bottle, (depending on the type of machine to which the apparatus is applied) activates a starting control 6 via a control boss 5 on a rod 4 secured to the centerer. The action of this control, via a pneumatic unit which will be described later, activates a cylinder 7, producing displacement of the piston of the cylinder downwards. The piston rod of the piston of cylinder 7 is connected via a lost motion device 8 to a tubular spindle 9. The spindle 9 is connected to a tube 10 having an outlet nozzle via a connector or socket 11. The tube 10 is mounted in channel 3 with a considerable space separating the two elements. The assembly formed by the cylinder 7, the spindle 9 a guide bushing 12 for the latter, the tube 10 and the channel 3 is held by a tubular support which consists of one part 13 joined to the support housing 1 and a tip threadably coupled to part 13 and to which the channel 3 is directly attached. The part 13 of the tubular support has an inlet 15 which leads to a corresponding liquid supply tank (not illustrated) so that liquid can flow in the annular cylindrical space between the tube 10 and the channel 3.

Compressed air is fed through the central tube 10 to the nozzle outlet from any suitable source of compressed air at a suitable regulated rate and pressure of relatively small values. The rate is approximately 150 liters per hour and the pressure is 0.2 Kg/cm$^2$. The liquid which passes through the annular cylindrical space between tube 10 and channel 3 leaves between the nozzle at the end of tube 10 and the channel 3. More precisely, the liquid is discharged from the end of the channel 3 when the tube nozzle is in a projected position as a result of the movement of the piston of the cylinder 7; when the bottle is filled the nozzle at the end of air duct is blocked and the pneumatic unit is then operated to reverse the flow of air, i.e. the direction of circulation, to the cylinder 7 to retract the air duct and close the opening or passage between the tube 10 and the channel 3.

The pneumatic unit consists of the control 6 which is constituted as an activating valve connected to a five-way distributor 16, a membrane amplifier 17 for sensing low pressure differences, two safety valves 18 and 19 and an equilibrium capacity regulator 20 for the low pressure circuit.

The activating valve 6 is activated by rod 4 when a bottle pushes against the centerer 2, as previously explained, said valve passing air to the five-way distributor which directs the air to the cylinder 7 which extends air duct 10 whereby the liquid outlet is opened. In the course of filling, the liquid which has risen in the bottle approaches the nozzle at the outlet of the air duct to produce a pressure increase on the membrane of the amplifier 17 which then operates to direct the passage of air to the opposite part of the distributor 16 causing upwards displacement of the piston in cylinder 7 thereby retracting the tube 10 and closing the outlet of liquid from channel 3.

More specifically, the supplied pressure of 0.2 Kg cm$^2$ and the approximate rate of 150 liters/hour acts one of the two sides of the membrane, holding it in one position. On the other side circulates a part of this same air, but via the equilibrium regulator 20 so that when the nozzle of tube 10 is blocked, the lack of equilibrium between the two sides produces the operation of amplifier 17 and thereby distributor 16. The values of this disequilibrium are extremely precise and sensitive. The lack of sensitivity would produce untimely closures and variations which would influence the level to which the bottle is filled.

The safety valves 18 and 19 are interposed in the circuit and travel on an exterior frame via any suitable mechanism. This mechanism acts on the valve 18 to prevent the passage of air to the membrane of the detector. The mechanism also acts on valve 19 by which air is injected at 6 Kg $cm^2$ via the tube 10 every time that a full bottle is withdrawn and another bottle to be filled is introduced whereby any residue of liquid which might remain in the nozzle is removed. The closing of the membrane is necessary as, without this, possible damage may be done by subjecting it to a greater working pressure than normal.

What is claimed is:

1. A valve assembly for liquid filling of bottles in a bottling machine comprising a tubular channel member having an inlet for the supply of liquid to be introduced into a bottle and an outlet for said liquid, an air duct slidably mounted within said tubular channel and having an outlet nozzle thereon, said air duct being movable between a retracted position on which said nozzle blocks the outlet of the tubular channel and an extended position in which the outlet of the tubular channel is open and liquid can be discharged therefrom, cylinder means for moving said air duct between said retracted and extended positions, means for discharging air from said air duct, means for sensing change in pressure of the air discharged from the air duct due to increase of liquid level in a bottle being filled, and means for operating said cylinder means to move the duct to its retracted position when a given level of liquid has been reached in the bottle.

2. An assembly as claimed in claim 1 comprising a housing in which said channel and cylinder means are secured, a bottle centerer slidably mounted on said housing and including means for actuating said cylinder means when a bottle is centered in position in said centerer.

3. An assembly as claimed in claim 1 wherein said cylinder means comprises a pneumatic cylinder, said means for operating said cylinder means comprising a pneumatic circuit including said sensing means and operating means, said operating means comprising a distributor and a pneumatic control coupled to said distributor.

4. An assembly as claimed in claim 3 wherein said distributor is a five-way distributor and said sensing means comprises a low pressure pneumatic circuit including a membrane subjected to regulated pressure on one side thereof and the pressure at the outlet of said duct on the other side thereof.

5. An assembly as claimed in claim 4 comprising a bottle centering means coupled to said pneumatic control to achieve the same when a bottle is centered in the centering means, said pneumatic control then feeding compressed air via the distributor to said cylinder means to move the air duct to extended position, said membrane being coupled to said distributor and sensing increased pressure at the duct outlet when the bottle is filled to a determined level to activate the distributor to reverse the pneumatic cylinder and cause the air duct to return to retracted position.

6. An assembly as claimed in claim 5 wherein said pneumatic circuit further comprises two safety valves one being coupled to said membrane to block passage of air to said membrane, the second safety valve being connected in the pneumatic circuit to feed high pressure air to said air duct, when the duct has been retracted and the first safety valve activated, to discharge the high pressure air through the nozzle and to clean the nozzle of any liquid residue remaining therein in the interval when a filled bottle is withdrawn and an empty bottle is inserted for filling.

7. An assembly as claimed in claim 1 comprising a support for said channel member, said air duct being slidably supported in said support, said support including a removable threadably mounted tip part to which said channel member is secured, said air duct including a removable threaded tubular tip portion with said nozzle thereon whereby for different diameter bottle necks the tubular tip portion of the air duct as well as the channel member and tip part can be replaced.

8. An assembly as claimed in claim 1 wherein said outlet of the channel member is constituted by two openings at most to eliminate production of scum.

9. An assembly as claimed in claim 1 wherein said cylinder means comprises a dual-action cylinder providing greater speed of operation in response to actuation thereof.

* * * * *